US006213669B1

(12) United States Patent
Yamamoto

(10) Patent No.: US 6,213,669 B1
(45) Date of Patent: Apr. 10, 2001

(54) INFLATABLE BINDER

(75) Inventor: Norman C. Yamamoto, Yorba Linda, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/336,325

(22) Filed: Jun. 18, 1999

(51) Int. Cl.[7] ..... B42F 3/00; B42D 3/00

(52) U.S. Cl. ..... 402/73; 402/70; 281/51; 281/29; 281/31; 281/36; 281/37; 281/21.1; D19/26; D19/27; D3/201; D3/206

(58) Field of Search ..... 402/70, 73; 281/51, 281/29, 31, 36, 37, 21.1; D19/26, 27; D3/201, 206

(56) References Cited

U.S. PATENT DOCUMENTS

| | | | | |
|---|---|---|---|---|
| D. 182,105 | | 2/1958 | Chase . | |
| D. 191,030 | | 8/1961 | Cole et al. . | |
| D. 212,148 | | 8/1968 | Dean . | |
| D. 350,365 | | 9/1994 | Kelley et al. . | |
| 1,565,630 | | 12/1925 | Egerton . | |
| 2,486,330 | | 10/1949 | Schade . | |
| 3,572,957 | * | 3/1971 | Strassberg . | |
| 3,715,816 | | 2/1973 | White . | |
| 4,280,241 | | 7/1981 | Pfaff . | |
| 4,720,012 | | 1/1988 | Dufour . | |
| 4,757,580 | | 7/1988 | Wolf . | |
| 4,848,798 | | 7/1989 | Moor . | |
| 4,863,191 | | 9/1989 | Termanis . | |
| 4,916,838 | | 4/1990 | Holson . | |
| 4,962,949 | | 10/1990 | Gibbs . | |
| 4,978,141 | | 12/1990 | Wu . | |
| 5,013,068 | | 5/1991 | Maldonado . | |
| 5,015,011 | | 5/1991 | York . | |
| 5,020,828 | * | 6/1991 | Moor . | |
| 5,069,568 | | 12/1991 | Acker . | |
| 5,219,437 | | 6/1993 | Moor et al. . | |
| 5,265,914 | | 11/1993 | Russell . | |
| 5,411,293 | | 5/1995 | Monzyk . | |
| 5,607,246 | * | 3/1997 | Podosek . | |
| 5,611,573 | * | 3/1997 | Lobel et al. | 281/29 |
| 5,617,662 | * | 4/1997 | Hwang | 40/700 |
| 5,662,447 | | 9/1997 | Tsai . | |
| 5,711,627 | | 1/1998 | Chapman . | |
| 5,911,441 | * | 6/1999 | Yamamoto et al. | 281/15.1 |
| 5,916,280 | * | 6/1999 | Lantz | 281/29 |
| 5,967,870 | * | 10/1999 | Bertoncelli et al. | 441/107 |

* cited by examiner

*Primary Examiner*—A. L. Wellington
*Assistant Examiner*—Alisa L. Thurston
(74) *Attorney, Agent, or Firm*—Oppenheimer Wolff & Donnelley

(57) ABSTRACT

The present invention provides an inflatable binder which has multiple air pockets which can be inflated by one or more air inlets. The binder is secured closed with a zipper or other enclosure. The material of the binder is a plastic sheet material or the like which provides for a water resistant binder. The inflated binder also provides cushioning to protect contents of the binder if dropped. In one embodiment, the front cover of the binder may have a central flat area surrounded by inflatable areas defining a frame, such that visual materials may be displayed from an inner pocket.

12 Claims, 4 Drawing Sheets

INFLATABLE BINDER

BACKGROUND OF THE INVENTION

1. Field of the Invention

The invention relates to a binder which can be inflated.

2. Description of the Related Art

Three ring binders, manufactured in a number of configurations, are well known in the art. Examples include binders with plastic exterior covers (U.S. Pat. No. 5,069,568), cloth covers (U.S. Pat. No. 5,219,437), and transparent outer sheets forming display pockets (U.S. Pat. No. Des. 350,365). Such covers serve not only to make binders more durable but also enhance the aesthetic appearance of the binder.

SUMMARY OF THE INVENTION

A general object of the present invention is to provide a binder of the ring type which is inflatable. The greater portion of the outer surface of said binder is covered with a layer which encloses trapped gas, preferably air, in air pockets which may be interconnected. Such a binder (1) provides a water resistant and floating cover to protect binder contents from liquid damage, (2) provides a binder cover with additional "cushioning" protection to protect binder contents from dropping and, (3) the quilted look of the binder provides a pleasing, whimsical appearance.

In one preferred embodiment, the outer surface of the binder may be formed of two thin flexible layers of plastic which are bonded together at their edges, and which are also bonded together along lines extending across the surface of the two sheets so that it has a "quilted" appearance and is divided into sections which may be intercoupled. The outer inflatable portion is preferably formed of radio frequency (RF) weldable material such as polyvinyl chloride or other such RF weldable material.

In another embodiment, a central area may be left flat, providing a transparent "window" through the cover, or providing a pocket with a transparent view through the cover, or providing a pocket with a transparent outer layer with a surrounding inflatable border providing a picture frame effect.

A closure such as a zipper may extend around three sides of the perimeter of the binder, away from the spine of the binder. This closure may be provided with adjacent sealing flaps, or may otherwise be made substantially water resistant.

The binder may be provided with one, two or more inlets through which air may be supplied under pressure to inflate the inter-coupled, quilted sections or pockets of the binder. These inlets can, for example, be in the form of a valve through which air may be blown to inflate the binder. Alternatively, the inflatable binder may be pre-inflated at the point of manufacture, for example, and then tightly sealed.

In accordance with one specific illustrative embodiment of the invention, the inflatable binder may have front and rear covers with the rear cover pivotally connected to a spine, with a ring binder for holding pages fastened to the binder near the spine. The front and rear covers are preferably transparent or translucent, but may be opaque. Air pockets are provided which cover the greater portion of the outer surface of the binder. The air pockets may be formed of an air pocket assembly including two layers of thin flexible plastic sheet material bonded together along their edges, and with lines of bonding over the surface of said binder to form interconnected air pockets. The air pocket assembly is secured to the outer surfaces of the binder, and this may be accomplished by providing two inner flexible plastic layers extending inward from the outermost two edges of the air pocket assembly to form big open pockets into which the front and rear covers extend, thus forming the complete inflatable binder assembly.

The resultant binder has a soft, resilient "feel" and may present a tinted transparent appearance. With the many air pockets and the closure on the open sides, the binder is water-resistant and has positive flotation properties such that said binder would float if accidentally dropped into a body of water. Also, with the resilient outer air pockets, the binder may be dropped without being damaged.

This object as well as other objects, features and advantages of the invention will become more apparent to those skilled in the art from the following description with reference to the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENTS

Disclosed herein is a detailed description of some of the best presently known modes of carrying out the invention. This description is not to be taken in a limiting sense, but is made merely for the purpose of illustrating the general principles of the invention. The overall organization of the present detailed description is for the purpose of convenience only and is not intended to limit the present invention.

Figure 1:
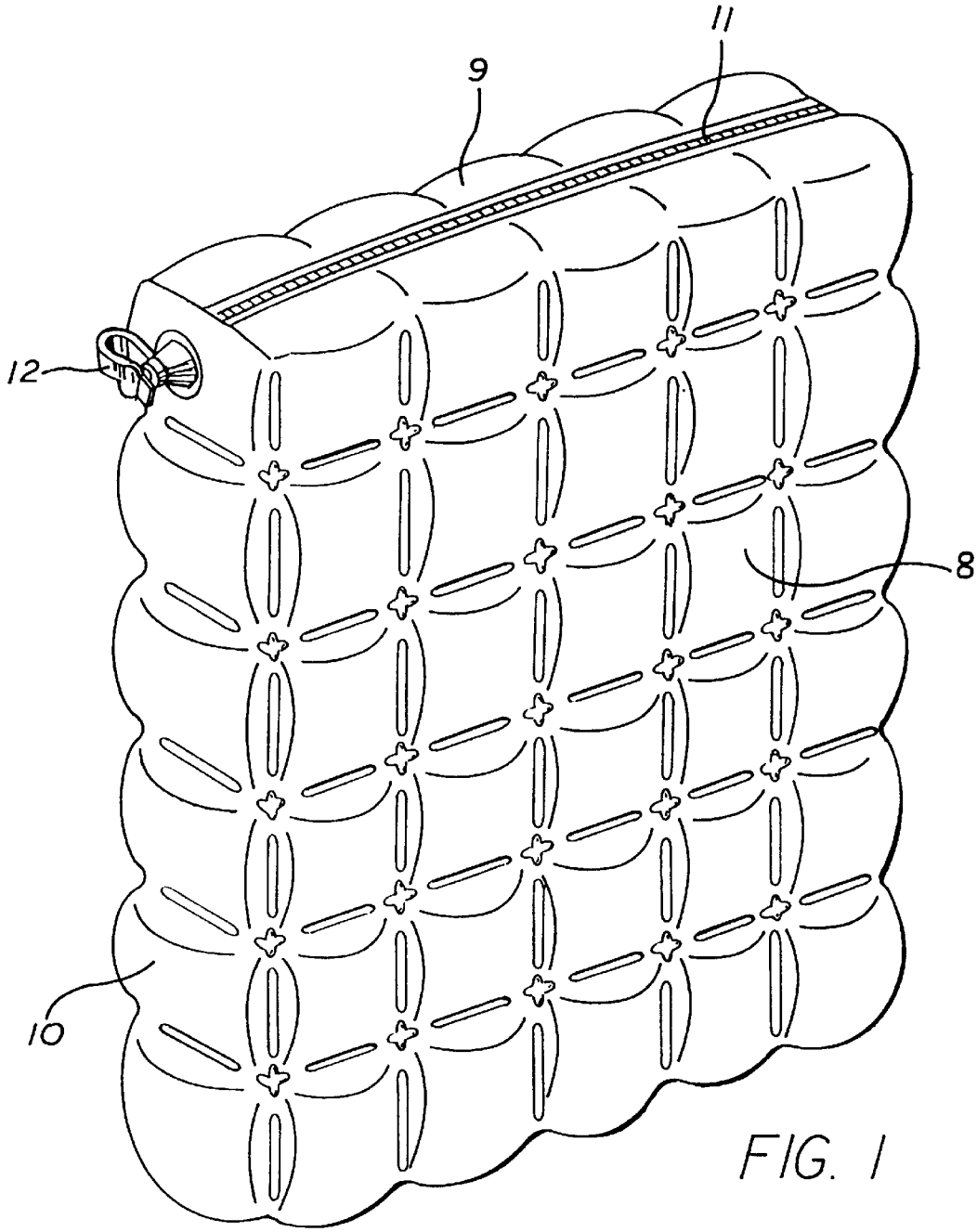
FIG. 1 is a perspective view of the present invention, an inflatable binder.

As shown in FIG. 1, one embodiment of the inflatable binder has inflatable, cushion-like front 8 and rear 9 covers which are joined to an inflatable spine 10. The free edges of the inflatable binder can be sealed shut by means of a zipper 11 or other mechanical interlocking device positioned and fixed about the three opening sides of the binder.

The outer construction of the binder is preferably of flexible vinyl material such as polyvinyl chloride or other radio frequency (RF) weldable plastic materials, although other materials may be utilized. Two sheets of such flexible material are first bonded together at the edges. Sufficient space is left between the two sheets so as to provide space for gas, preferably air. The air provides for a cushion-like effect. The two bonded sheets may be further bonded together along lines extending along the length and/or the width of the surface of the binder, in a "quilt" like fashion. This additional bonding may be complete so as to provide for individual inflatable "chambers" or incomplete so as to create a series of intercoupled chambers.

The chambers may be inflated by providing air via one or more inlets such as inlet valve 12 through which air may be blown to inflate the binder. Alternatively, the air pockets may be pre-inflated at the point of manufacture. The air pressure provided through such an inlet would permeate the individual or intercoupled air pockets in the binder and provide for a fully inflated binder.

Figure 2:
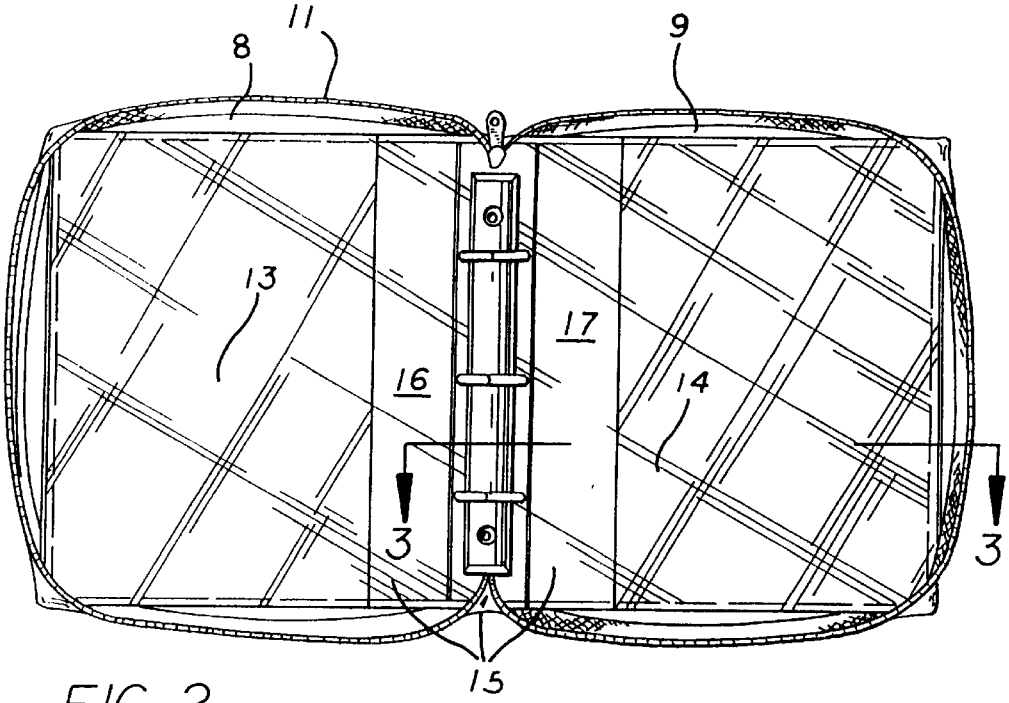
FIG. 2 is an inside view of the inflatable binder showing the left and right interior.
Figure 3:
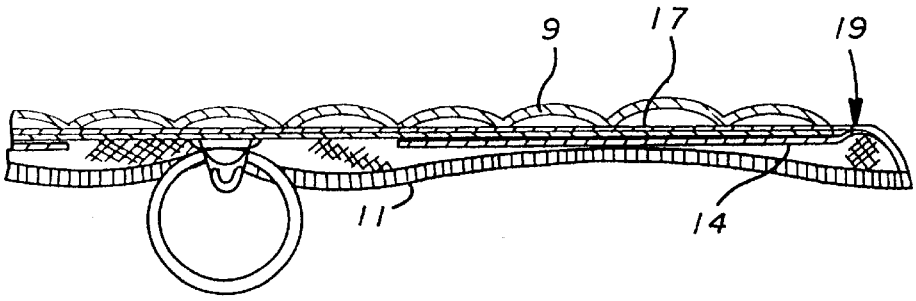
FIG. 3 is a cross-sectional view of the inflatable binder taken along line 3—3 of FIG. 2.

The inside covers of the binder, as shown in FIG. 2, may each provide a pocket 13, 14, preferably of transparent material, into which a more rigid plastic binder assembly 15 may be inserted. The binder assembly 15 includes two more rigid plastic covers 16, 17 which may be transparent, translucent, or opaque and a paper retention assembly 18. The more rigid binder covers provide integrity to the binder overall and slip readily into the inside pockets 13, 14 as shown in FIGS. 2 and 3. The paper retention assembly 18 may be of the three ring variety, as shown in FIG. 2, or of any other suitable design for holding paper.

The inside pockets 13, 14, of the inflatable binder, as shown in FIGS. 2 and 3, are not inflatable, but rather, are formed from single sheets of flexible material bonded to the outer inflatable covers 8, 9, by RF welding or other suitable bonding. Such a bond 19 is indicated in FIG. 3. Also, as shown in FIG. 2, the inside pocket 13 may be transparent and, alternatively, in another embodiment of this invention shown in FIG. 6, may provide for a pocket into which a picture or other viewable material may be inserted.

Figure 4:
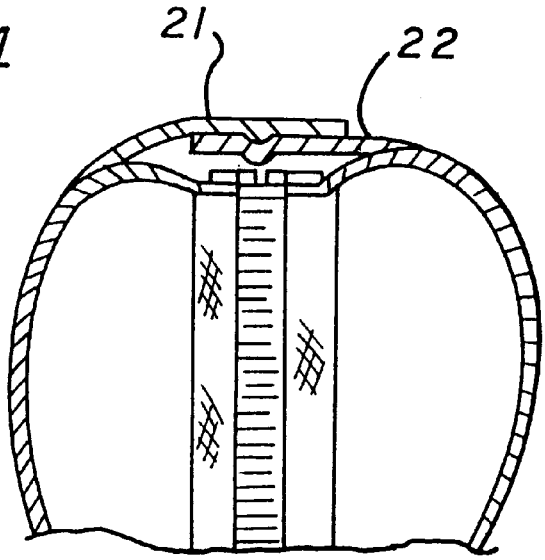
FIG. 4 is a detailed cross-sectional view of an edge of the binder showing an extra flap for increasing the water resistance of the binder.

The binder can be secured shut by means of a zipper 11 or other such closure or fastener which is attached by stitching or RF welding of the fastener to the opening perimeter of the binder. The zipper 11 or closure wraps from the top of the spine around the rightmost and bottom perimeters of the binder, terminating at the bottom of the spine. In addition, as shown in FIG. 4, the closure or fastener may be provided along with sealing flaps 21, 22 which encase the closure or fastener providing for greater security in closing and water-tightness.

Figure 6:
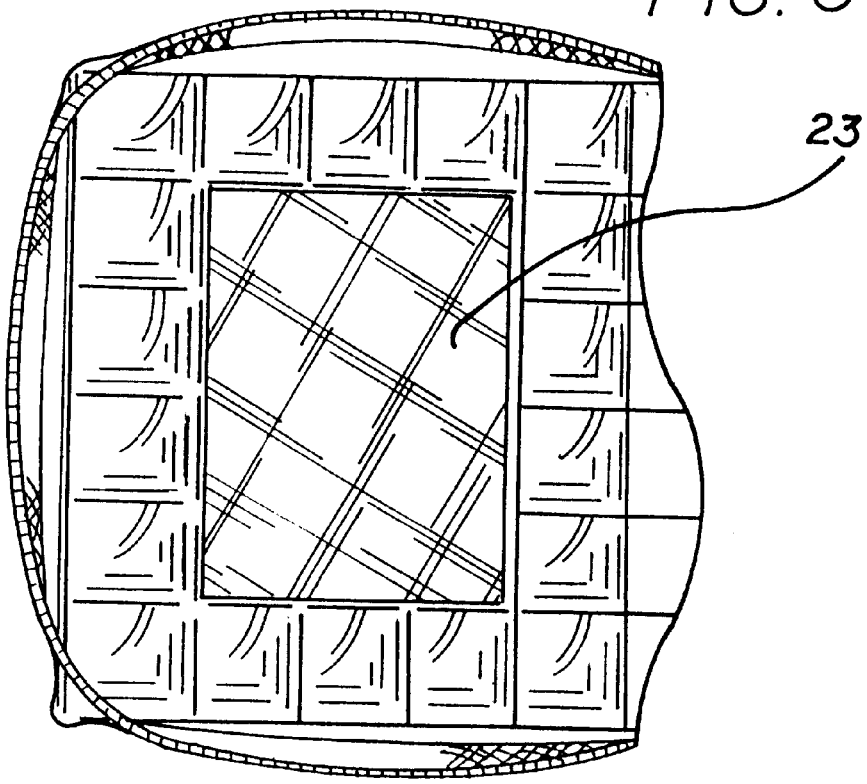
FIG. 6 is an inside front cover view of an inflatable binder with a transparent view window as shown in FIG. 5.
Figure 5:
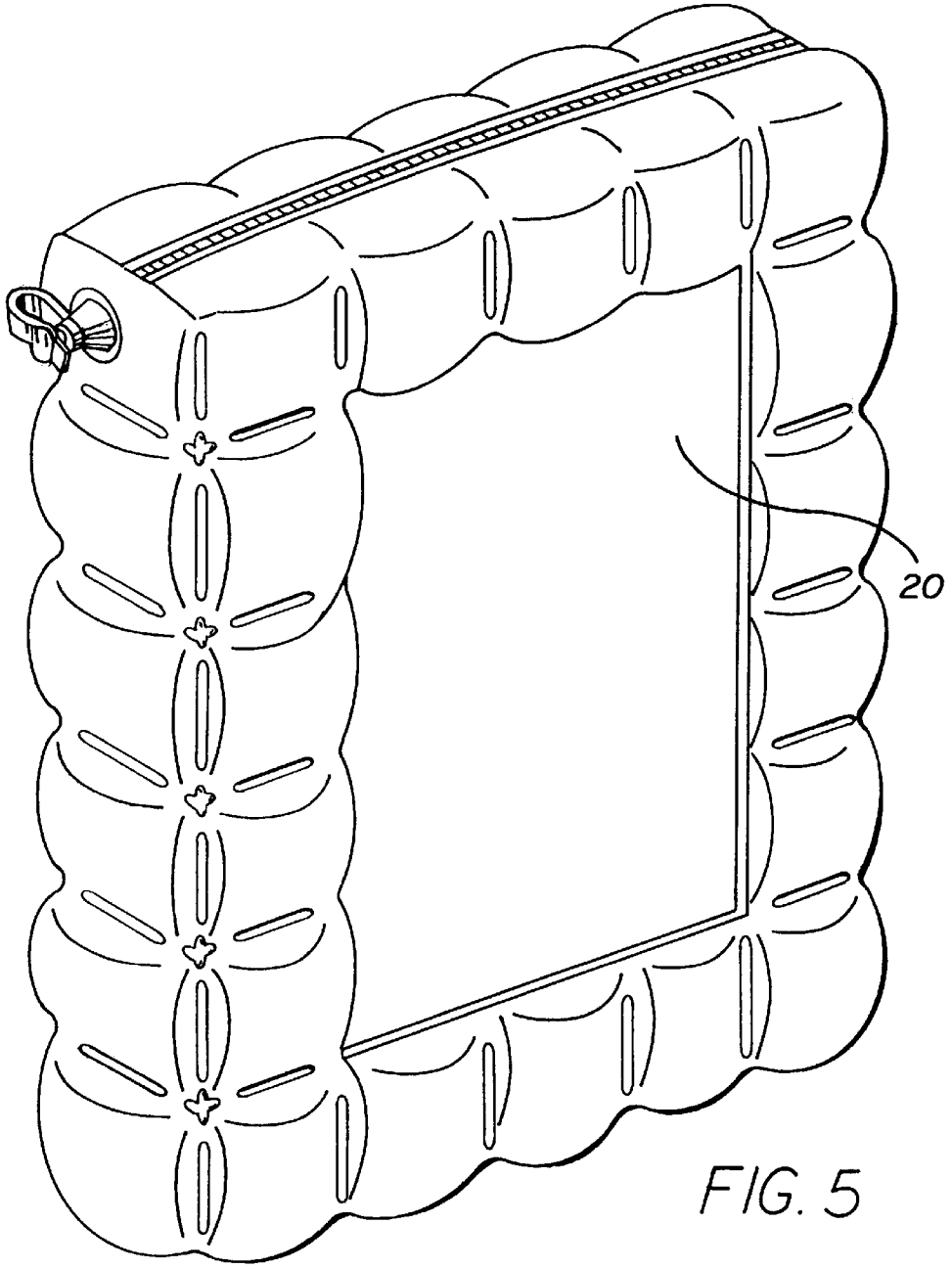
FIG. 5 is a perspective view of an alternative embodiment of the present invention showing a binder with a transparent view window and an inflatable border.

In an additional embodiment of this invention, the construction of the inflatable binder is essentially as shown in FIG. 1 but, as shown in FIGS. 5 and 6, the front panel of the inflatable binder is not completely covered with inflatable pockets. Instead, a portion of the flexible material of which the cover is constructed may be left flat, without pockets, providing for a view through the cover 20. This transparent viewing window 20 will thus have a surrounding inflatable border, the result being a "picture frame" like appearance as shown in FIG. 5. In such an embodiment, as shown in FIG. 6, the inside cover opposite the viewing window 20 may provide an additional pocket 23, with one open end, into which a picture or other viewable material may be inserted to be viewed from the outside. Alternatively, the inside pocket 13, as shown in FIG. 2 and described above, could be used for this purpose of inserting a visual image for viewing from the outside through the viewing window.

In closing, it is noted that specific illustrative embodiments of the invention have been disclosed hereinbefore. However, it is to be understood that the invention is not limited to these specific embodiments. Thus, by way of example, but not of limitation, the inflatable binder can be of various colors, transparent, translucent or opaque, may be inflated by mouth or other device which provides air or other inflating gas. The closure may be a zipper or any other such mechanical closure providing a barrier between the free edges of the binder and the outside. The vinyl material of construction need not be limited to vinyl, but may be of any flexible and resilient material, either opaque, translucent or transparent. The binder may be of a standard size to accommodate 8.5"×11" sheets of paper or of variable sizes such as 10.25"×8.75" which accomodates half-size sheets, or of any other size suitable for accomodating numerous diverse paper sizes. Additionally, the air pockets may be of various sizes and number, either completely or incompletely distributed over the covers and spine of the binder. Further, the shape of the air pockets may be square or of other interesting shape which can be formed by RF welding or other bonding process. Accordingly, the invention is not limited to the precise embodiment described in detail hereinbefore.

We claim:

1. An inflatable enclosed binder comprising:

inflatable covers and spine formed of two thin, flexible layers of plastic bonded together at the edges, with space provided in-between for air, and on which there is secondary bonding in the form of lines extending along the width and/or length of the binder creating a quilt-like pattern of inflatable air pockets;

inner pockets formed by bonding a single flexible layer of plastic respectively onto each of the inner sides of both of the inflatable covers;

an inner binder comprising semi-rigid to rigid covers, a spine and a paper retention assembly; said semi-rigid or rigid covers being insertable respectively into said inner pockets on each of the inflatable covers;

at least one inlet into which gas, preferably air, may be blown in order to inflate said air pockets;

a mechanical closure extending around and securing the perimeter of the opening edges of the binder; and said covers including said air pockets extending over the greater portion of the outer surface of said covers.

2. A binder as defined in claim 1 wherein said thin flexible layers are made of plastic such as vinyl or polyvinylchloride and are such that they can be radio frequency welded.

3. A binder as defined in claim 1 wherein said thin flexible layers of plastic are transparent or translucent, and are of clear or tinted coloration.

4. A binder as defined in claim 1 wherein said secondary bonding gives rise to inflatable air pockets whose shape is generally rectangular.

5. A binder as defined in claim 1 wherein said inflatable air pockets do not entirely cover the surface of the covers and spine.

6. A binder as defined in claim 1 wherein there is more than one inlet.

7. A binder as defined in claim 1 wherein said air pockets have been pre-inflated at the time of manufacture and the inflatable area has been permanently sealed so as to prevent loss of air.

8. A binder as defined in claim 1 wherein said closure is a zipper enclosed by flaps; said flaps seal tightly to provide for additional security and resistance against the elements.

9. An inflatable enclosed binder comprising:

an inflatable spine, along with front and rear covers formed of two thin, flexible layers of plastic bonded together at the edges; said layers having space provided in-between for air, and bonded along lines extending the width and/or length of the binder to form inflatable air pockets;

a flat, uninflatable central portion of plastic on the cover of the binder which provides for a viewing window and which is bordered by said air pockets;

inner pockets formed by bonding a single flexible layer of plastic respectively onto each of the inner sides of both of the inflatable covers;

an inner binder comprising semi-rigid to rigid covers, a spine and a paper retention assembly; said semi-rigid or rigid covers fitting into said inner pockets;

a "picture" pocket provided behind said viewing window with at least one side of the pocket open to receive a visual image;

at least one inlet into which gas, preferably air, may be blown in order to inflate said air pockets;

a mechanical closure extending around and securing the perimeter of the opening edges of the binder.

10. A binder as defined in claim 9 wherein said thin flexible layers of are made of plastic such as vinyl or polyvinylchloride, and are such that they can be radio frequency welded.

11. A binder as defined in claim 9 wherein said thin flexible layers of plastic are transparent or translucent and are of clear or tinted coloration.

12. A binder as defined in claim 9 wherein the closure is a zipper or the like and which is enclosed by flaps; said flaps close tightly providing for additional security and resistance against the elements.

* * * * *